United States Patent [19]

Scollins

[11] 4,004,684

[45] Jan. 25, 1977

[54] FUZE PROTECTOR CAP

[75] Inventor: John A. Scollins, Oak Grove, Va.

[73] Assignee: The United States of America as represented by the Secretary of the Navy, Washington, D.C.

[22] Filed: May 27, 1976

[21] Appl. No.: 690,449

[52] U.S. Cl. ..... 206/3; 220/319; 220/324

[51] Int. Cl.[2] ..... F42B 37/00

[58] Field of Search ..... 206/3, 527; 215/273–275; 220/315, 319–320, 322–324, 326

[56] References Cited

UNITED STATES PATENTS

| | | | |
|---|---|---|---|
| 684,384 | 10/1901 | Rowe | 220/322 |
| 700,344 | 5/1902 | Lispenard | 215/273 |
| 808,854 | 1/1906 | Mayer | 206/3 |
| 847,833 | 3/1907 | Schwarz | 206/3 |
| 2,005,756 | 6/1935 | Schilling et al. | 206/3 |

FOREIGN PATENTS OR APPLICATIONS

| | | | |
|---|---|---|---|
| 740,960 | 2/1933 | France | 206/3 |

*Primary Examiner*—Steven E. Lipman

[57] ABSTRACT

A deep drawn cap for protecting the fuze in a projectile which fits over the fuze and is retained in place by an E clip. An O ring provides a weather tight seal between the cap and the projectile.

4 Claims, 2 Drawing Figures

FUZE PROTECTOR CAP

BACKGROUND OF THE INVENTION

This invention relates generally to fuze protector caps and more particularly to a protector cap which will safeguard a fuze from the elements, during storage and rough handling, when the fuze is assembled to a projectile.

In the past, projectile fuzes have frequently been protected during storage and handling by keeping them separate from the projectiles in containers such as those disclosed in U.S. Pat. Nos. 1,188,871; 2,025,339; 2,308,480; and 2,308,481. An alternative approach was to encase the entire projectile as taught by U.S. Pat. Nos. 2,396,061 and 2,721,652. Also, protective caps have been threaded directly on the projectile over the fuze using threads cut into the ogive. Transporting projectile and fuzes separately is inefficient, encasing entire projectiles is unduly expensive, and threads on the projectile ogive are ballistically unsatisfactory.

SUMMARY OF THE INVENTION

The present invention obviates the aforementioned disadvantages by providing a protector cap which covers only the fuze of a fuze and projectile assembly; the projectile body not requiring any protection during normal handling and storage. The protector cap is held on the projectile ogive by an E-clip and is provided with an O-ring to preclude entry of moisture.

DESCRIPTION OF THE PREFERRED EMBODIMENT

Figure 1:
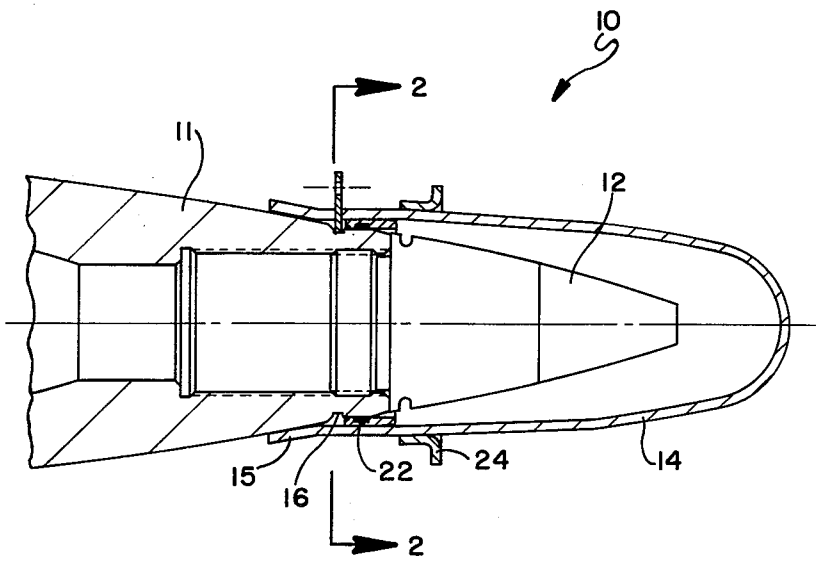
FIG. 1 is a fragmentary view, partially in section, showing the fuze protector cap of the present invention mounted on the ogive of a projectile.
Figure 2:
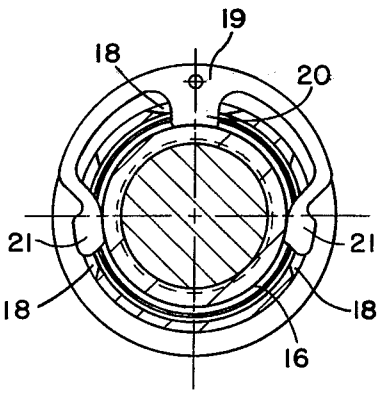
FIG. 2 is a sectional view taken along the line 2—2 of FIG. 1 and illustrating the E-clip ring or snap ring which retains the cap on the projectile.

Referring now to the drawings, there can be seen in FIG. 1 the fuze protector cap, designated generally by the reference numeral 10, mounted on the ogive of a projectile 11 (partially shown) having a fuze 12 mounted on the nose of the projectile. The cap 10 comprises a deep drawn cup 14, of steel or other suitable material, having the open end 15 thereof flared to mate with the ogive of the projectile 11. In the event the projectile is dropped on its nose during handling, the flared portion 15 transmits the load to the projectile

11 rather than the means which retains the cap 10 on the projectile.

The projectile 11 is provided with a circumferential groove 16 which is sensed by the fuze setting operation. The cup 14 has three slots 18 formed therein which are radially aligned with the groove 16 when the cap 10 is on the projectile 11 with the flare 15 engaging the ogive. An E-clip ring or snap ring 19, having an inner tip 20 and a pair of outer tips 21, serves to hold the cup 14 on the projectile 11 when the tips 20 and 21 have been pushed through the slots 18 and into the groove 16; the points of contact of the tips 21 being circumferentially spaced greater than 90° from the tip 20. Obviously, snap rings of other configurations may also be used.

An O-ring 22 is provided within a groove in the interior of the cup 14 and engages the ogive of the projectile 11 to provide a waterlight seal which precludes moisture from reaching the fuze 12. When projectiles are shipped, it is customary to stand them vertically in lots of 12 (for 5 inch projectiles) in a pallet resting on their bases. An upper pallet is then placed over the projectiles, and protector caps, and fastened to the lower pallet to form a rigid package. A ring 24 is welded or brazed on the exterior of the cup 14 for engaging the upper pallet to preclude axial movement of the projectiles during shipping.

Obviously, many modifications and variations of the present invention are possible in the light of the above teachings. It is therefore to be understood that within the scope of the appended claims the invention may be practiced otherwise than as specifically described.

What is claimed is:

1. A cap for protecting fuzes on projectiles during storage and handling, said projectiles being provided with a circumferential fuze setting groove, comprising:

a deep drawn cup having the open end thereof flared to mate with the ogive of the projectile;

at least three slots circumferentially spaced on the wall of said cup; and a snap ring having at least three lips adapted to project into said slots and engage the fuze setting groove on the fuze for retaining said cup on the projectile.

2. A fuze protector cap as defined in claim 1 wherein said snap ring is an E-clip ring.

3. A fuze protector cap as defined in claim 1 wherein an O-ring is disposed within said cup for engaging the ogive of the projectile to provide moisture protection for the fuze.

4. A fuze protector cap as defined in claim 2 wherein an O-ring is disposed within said cup for engaging the ogive of the projectile to provide moisture protection for the fuze.

* * * * *